United States Patent [19]

Simonnet

[11] Patent Number: 4,687,463

[45] Date of Patent: Aug. 18, 1987

[54] CENTRIFUGAL DECANTER OF THE PENDULOUS TYPE

[75] Inventor: Jacques Simonnet, Saint-Remy-Les-Chevreuse, France

[73] Assignee: Cogema, Velizy-Villacoublay, France

[21] Appl. No.: 787,810

[22] Filed: Oct. 16, 1985

[30] Foreign Application Priority Data

Jul. 1, 1985 [FR] France ..... 85 10015

[51] Int. Cl.[4] ..... B04B 9/00

[52] U.S. Cl. ..... 494/83; 494/46; 494/84

[58] Field of Search ..... 494/84, 83, 82, 85, 494/39, 46, 47; 210/781, 782, 360.1

[56] References Cited

U.S. PATENT DOCUMENTS

| | | | |
|---|---|---|---|
| 2,932,975 | 4/1960 | Racz | 494/46 |
| 3,322,338 | 5/1967 | Stallman | 494/82 |
| 4,234,123 | 11/1980 | Cory | 494/83 |
| 4,341,342 | 7/1982 | Hara | 494/84 |
| 4,534,755 | 8/1985 | Calvert | 494/84 |

FOREIGN PATENT DOCUMENTS

| | | |
|---|---|---|
| 740060 | 10/1943 | Fed. Rep. of Germany . |
| 917180 | 8/1954 | Fed. Rep. of Germany . |
| 1657282 | 4/1971 | Fed. Rep. of Germany . |
| 2112834 | 10/1971 | Fed. Rep. of Germany . |
| 2611386 | 9/1977 | Fed. Rep. of Germany . |
| 952111 | 11/1949 | France . |
| 2577170 | 8/1986 | France . |
| 114756 | 9/1983 | Japan . |
| 76561 | 8/1984 | Japan . |

*Primary Examiner*—Robert W. Jenkins

*Attorney, Agent, or Firm*—Shenier & O'Connor

[57] ABSTRACT

This invention relates to a centrifugal decanter comprising a rotor connected to a motor for driving in rotation by a vertical shaft suspended in pendulous manner by a swivel joint supported by a fixed connected seat. Springs for returning the shaft into vertical position are provided, in the form of compression springs arranged so as to relieve the swivel joint of the weight of the rotating system that it supports.

12 Claims, 4 Drawing Figures

CENTRIFUGAL DECANTER OF THE PENDULOUS TYPE

The present invention relates to a centrifugal decanter of the pendulous type, incorporating a rotor which comprises a rotating vessel and a vertical rotating shaft connecting said vessel to a motor for driving in rotation, this shaft being suspended by means of a swivel joint centred on its axis, supported by a fixed connected seat and supporting the shaft via a bearing which allows rotation thereof in the swivel joint, the active surfaces of the swivel joint and of its seat being limited to relatively narrow equatorial spherical zones, whilst compression springs, regularly distributed about the shaft and ensuring the return thereof into neutral position, are interposed between points fast with the swivel joint and fixed points.

The expression "equatorial spherical zones" means that the surfaces in question extend between two parallel planes close to the equator of the swivel joint, the axis of the rotating shaft being considered as the line of the poles thereof.

Machines incorporating a swivel joint suspension thus designed present the advantage, over those where the swivel joint and its seat are constituted by polar caps, of ensuring a perfect maintenance of the shaft in the transverse direction. On the other hand, being given that the active surfaces of the swivel joint and of its seat extend, not substantially horizontally as in the case of polar caps, but substantially vertically, the weight of the rotating system supported by the swivel joint in its seat generates considerable stresses at the level of these elements, hence the existence of considerable friction between their surfaces in contact. Such friction creates risks of ins.tability in the operation of the decanter in the event of unbalance, and this all the more so as the load of the rotating system is high.

It is an object of the invention to reduce the frictions between the swivel joint and its seat, by reducing the detrimental influence of the weight of the mobile system on the conditions of contact between these two suspension elements.

To this end, according to the invention, the said return springs are arranged so that the elastic force that they exert on the swivel joint due to their compression is directed upwardly and compensates at least partially the weight (essentially that of the rotor and of its load) which the swivel joint supports in its seat. This arrangement ensures take-up of said weight by the springs by relieving the swivel joint and its seat, which then have virtually no more than a function of guiding of the shaft, and this all the better as the compensation of the weight is more perfect, with concomitant disappearance of the forces of friction generated by the effect of said weight. Due to the absence of friction, it is indispensable to provide the machine with viscous dampers which control the movements of the swivel joint and ensure operational stability under all the conditions of load.

The springs are preferably placed under pre-stress, their degree of pre-stress being adjustable, for example with the aid of a compression member whose position is adjustable.

The springs are preferably coupled to the swivel joint and to its seat via two substantially horizontal plates, namely a first plate fast with the swivel joint and a second fixed plate, fast with the seat thereof.

When the first plate lies above the second plate, the springs may be interposed between the two plates, or may be disposed above the first plate.

In the first case, each of the springs may abut directly on the second plate and, on the first plate, via a bush screwed in this plate, making it possible, by rotation, to adjust the pre-stress of the spring.

In the second case, the lower end of each spring abuts on the second plate via a respective small column on which the spring is mounted and which passes through the first plate, the latter abutting on the upper end of said spring via a connecting member which is constituted by a sleeve coaxial to the column and enclosing the spring, closed at its upper end by a threaded stopper of position adjustable by screwing in the sleeve, and at its lower end by a bottom presenting a threaded central hole in which is screwed a bush passing through the first plate with the column and possessing a flange on which this plate rests.

When the decanter comprises a housing which encloses the swivel joint suspension, the plates and the return springs, openings must be provided in said casing, with a view to adjusting the pre-stress of the springs, opposite the corresponding adjusting members.

The angular return of the rotor into neutral position may be ensured, apart from by the springs for compensating the weight of the rotor, by complementary return springs. In an advantageous variant embodiment, the springs for compensating the weight of the rotor are dimensioned and arranged so as to ensure, alone, the angular return of the rotor into neutral position.

The invention will be more readily understood on reading the following description with reference to the accompanying drawings, in which.

Figure 1:
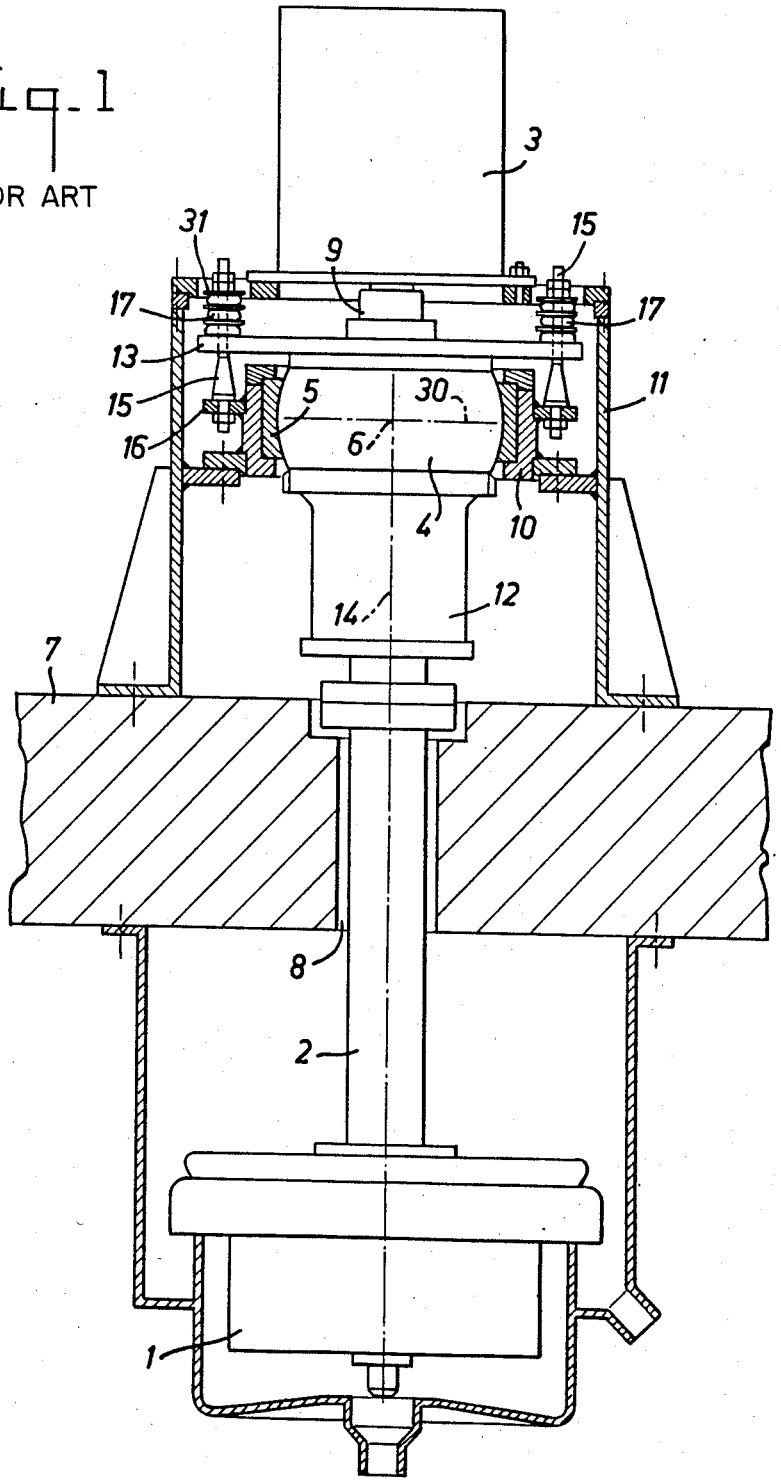
Fig. 1 PRIOR ART
FIG. 1 shows, in axial section, a centrifugal decanter according to the prior state of the art.

Referring now to the drawings, the machine shown in FIG. 1 comprises a rotor incorporating a rotating vessel 1 and a vertical shaft 2. The vessel 1, adapted to receive the load to be centrifuged, is connected by shaft 2 to a motor 3 for driving in rotation located in the upper part of the machine. The shaft 2 is suspended in pendulous manner by a swivel joint 4 mounted in an annular seat 5 with spherical inner surface, so that it may make slight angular displacements about the centre 6 of the swivel joint 4. The shaft 2 passes through a protecting slab 7 via an opening 8 leaving a certain clearance therearound for said angular displacements not to be hindered. For the same reason, on that part of the shaft 2 located between the swivel joint 4 and the motor 3, there is interposed a supple coupling member 9.

The seat 5 is mounted in an annular support 10 fast with a fixed casihg 11 enclosing the swivel joint suspension mechanism. This casing supports the motor 3 and is fastened to the protecting slab 7. Shaft 2 rotates inside the swivel joint 4, which is stationary, in a bearing comprising ball bearings (not shown in the Figure) fitted in a cylindrical passage made through the swivel joint 4 and continuing inside a sleeve 12 lying below said joint, with which it is integral.

Likewise fast with the swivel joint, there is provided a plate 13 which extends in a plane perpendicular to the axis 14 of the shaft 2. This plate is traversed over its periphery by four small columns 15, disposed parallel to axis 14 and regularly distributed about the swivel joint 4, which are fixed, at their lower end, to a second fixed plate 16 constituted by an annular flange fast with the support 10 of the seat 5 and lying below the plate 13. On each column 15 there is fitted a compression spring 17 interposed between the plate 13 and a washer 30 fitted at the top of the column. The springs 17, which may be formed by stacks of rubber rings or Belleville washers, or by helicoidal springs, constitute elastic members for returning the shaft 2 into vertical position.

Furthermore, the movements of shaft 2 about the centre 6 of the swivel joint 4 are braked by dampers (not shown).

FIG. 1 shows that, the active parts of the swivel joint 4 and of its seat 5 being limited to spherical zones close to the equator 30, the surface of these active parts is slightly inclined with respect to the vertical, with the result that they are the seat of considerable efforts due to the weight of the rotating system, to which are added the forces of compression of the springs 17. This results in disturbing frictions of high value. It is true that such frictions may be reduced by the interposition of a film of lubricating material, such as Teflon, between the swivel joint 4 and its seat 5; however, such a measure proves in practice to be insufficient.

Figure 2:
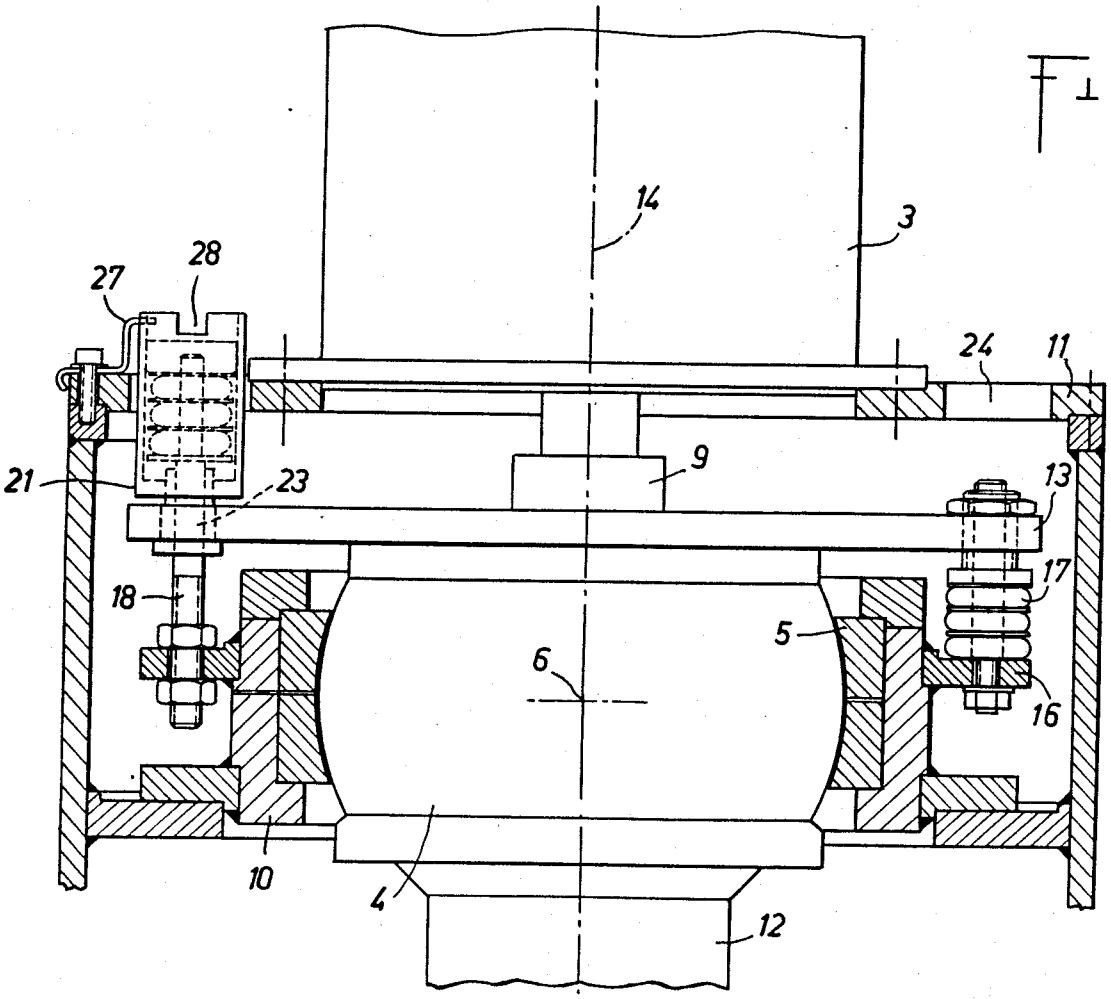
FIG. 2 shows, on a larger scale, the swivel joint suspension of the decanter of FIG. 1, arranged in accordance with the invention in two embodiments.

Referring now to FIG. 2, the right-hand side thereof shows that each spring 17 is, according to the invention, interposed between plates 13 and 16. This results in that the forces of compression developed by the springs 17 tend to push upwardly the plate 13 on which they act in the direction opposite the weight of the assembly of the rotor to be relieved, constituted by the rotating vessel 1, the shaft 2 and the swivel joint 4, including the sleeve 12 connected to the latter. The action of this weight on the swivel joint suspension may thus be reduced, and even annuled, if each of the n springs 17 is adjusted so that it develops an effort of compression equal to the above-mentioned weight divided by n.

Figure 3:
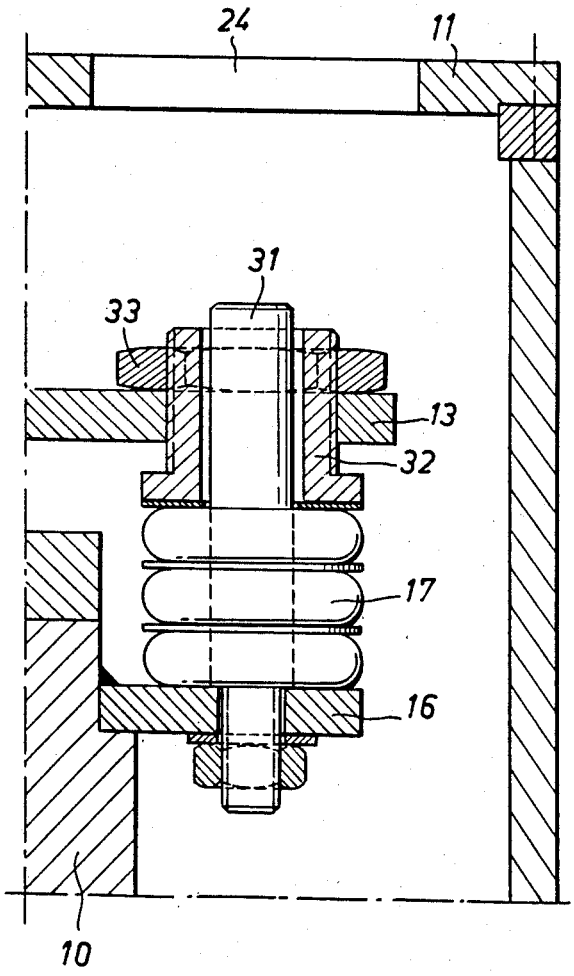
FIGS. 3 and 4 show, on an even larger scale, the right-hand part and the left-hand part, respectively, of the object of FIG. 2.

FIG. 3 shows how the springs 17 illustrated in the right-hand part of FIG. 2 are arranged. Each of these springs is mounted on a guiding column 31 fixed, like columns 15 of FIG. 1, to the fixed plate 16. On column 31 is likewise mounted a bush 32, the spring 17 being capable of being compressed between this bush and the plate 16. The degree of pre-stress thus applicable to the spring is adjustable by imparting a movement of rotation to the bush 32, of which the threaded outer surface is screwed in a threaded hole made in the plate 13, via an opening 24 provided at the top of the casing 11 opposite each of the springs 17. After adjustment of the pre-stress, each bush 32 is blocked with the aid of a stop counternut 33.

Figure 4:
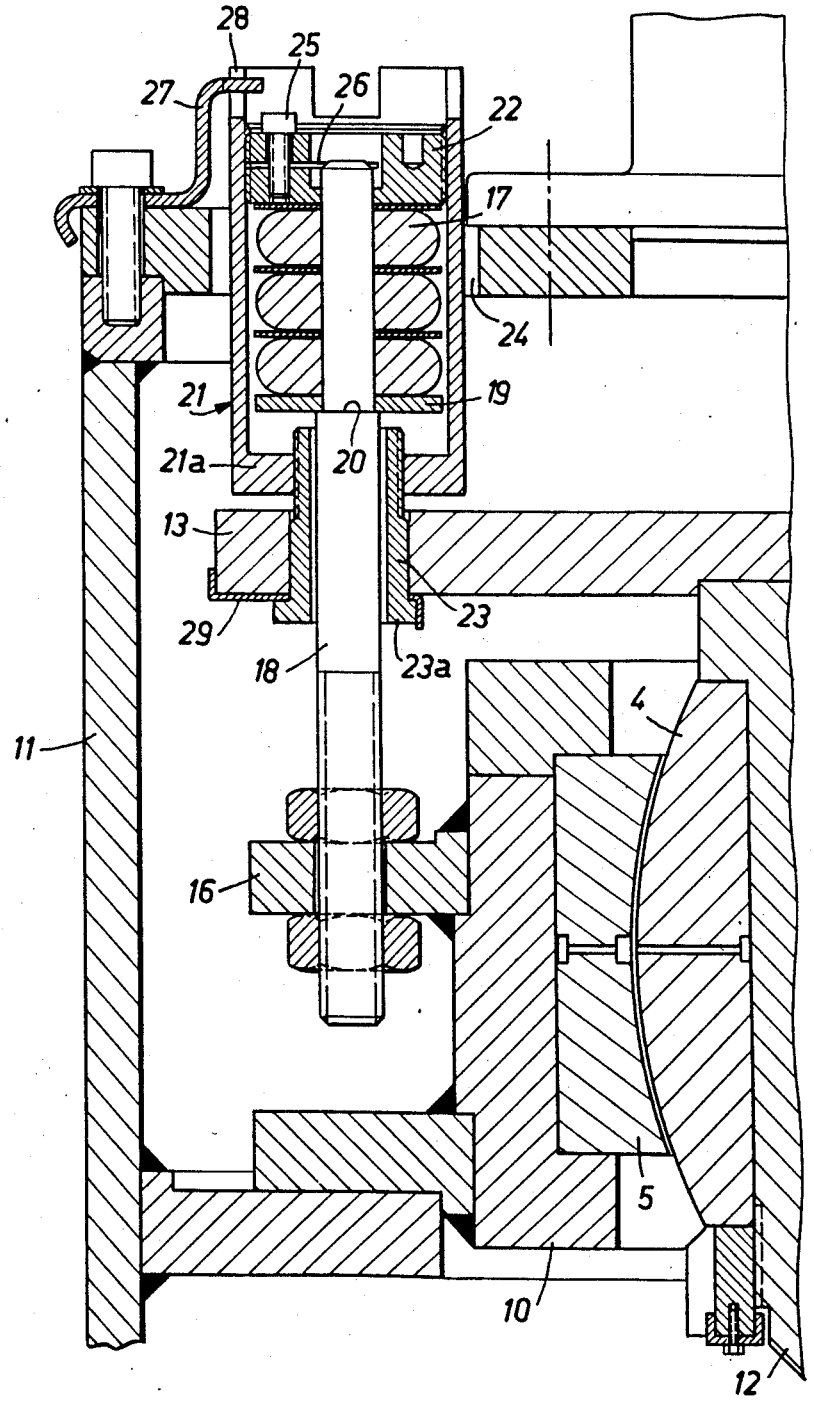

The left-hand part of FIG. 2 shows a variant assembly of the springs 17. This variant embodiment is also illustrated in FIG. 4. Here, columns 18 are used, comparable to columns 15 and 31 mentioned above fixed to plate 16. However, columns 18 pass freely through plate 13 fast with the swivel joint 4 and extend thereabove to receive the respective springs 17. Each of these springs 17 abuts by its lower end on the corresponding column, therefore on the fixed plate 16, and this via a washer 19 resting on a shoulder 20 of the column. As for plate 13, it abuts on the top of spring 17, via a spacer member constituted by a sleeve 21 enclosing the spring, closed in its upper part by a threaded stopper 22 and mounted by screwing of its bottom 21a on a bush 23. This bush, which is immobilized in rotation by a stop member 29, passes through the opening for passage of column 18 in the plate 13 and terminates in a flange **23*a*** on which the latter abuts.

The position of the stopper 22 in the sleeve 21 and of the latter with respect to bush 23, therefore to plate 13, is adjustable by screwing or unscrewing these elements. This makes it possible to adjust the degree of pre-stress given to each of the springs 17. Such adjustments are rendered possible by the presence of openings 24 provided at the top of the casing 11 opposite the springs 17 and the members 21, 22 associated therewith. In the present example, the sleeves 21 emerge from casing 11 through openings 24. Once the adjustments have been made, the stopper 22 is blocked by means of a screw 25 broaching on a slot 26 presented by the stopper; similarly, the sleeve 21 is immobilized by means of a stop member 27 introduced into one of the notches 28 presented by the head of the sleeve.

Due to their crown-like arrangement around axis 14 of the rotor, the springs 17 further give the swivel joint suspension an angular stiffness $K_\theta$ given by the formula (in moment applied per unit of angle of inclination of shaft 2):

$$K_{\theta r}=K_\theta,$$

where R is the distance of the springs to axis 14 and k the linear stiffness of each spring.

Now, the constructor of a centrifugal decanter of pendulous type generally seeks an angular stiffness of determined value for the suspension, which ensures a stable operation of the machine and the obtaining of a vibratory level which is as low as possible. Such angular stiffness, designated by $K_{\theta r}$, may be attained by the addition of complementary angular return springs which may be disposed either parallel or perpendicularly to axis 14. In the first case, these complementary springs must not be preloaded, in order not to disturb the action of relief of the swivel joint of springs 17. It is also possible to optimalize the characteristics and parameters of assembly of said springs 17, so as to produce the condition:

$$K_{\theta r}=K_\theta,$$

springs 17 then ensuring not only the relief of the swivel joint, but also the angular return thereof with the desired value.

With the springs mentioned above are associated dampers necessary for the stable operation of the machine at all speeds. Such dampers may be disposed either parallel to axis 14, between plate 13 and respective fixed points, or perpendicularly to said axis, between sleeve 12 and respective fixed points.

What is claimed is:

1. In a centrifugal decanter of the pendulous type, incorporating a rotor which comprises a rotating vessel and a vertical rotating shaft connecting said vessel to a motor for driving in rotation, this shaft being suspended by means of a swivel joint centered on its axis, supported by a fixed connected seat and supporting the shaft via a bearing which allows rotation thereof in the swivel joint, the active surfaces of the swivel joint and of its seat being limited to relatively narrow equatorial spherical zones, a plurality of compression springs, means mounting said springs at regularly spaced locations about said shaft, each of said mounting means comprising a first element secured to said seat and a second element secured to said joint with one of said springs biased between said elements so as to exert an upwardly directed restoring force on said joint, said springs ensuring the return of said joint into neutral position and compensating at least partially for the weight of the members supported by the swivel joint.

2. The centrifugal decanter of claim 1, wherein said springs are placed under pre-stress and their degree of pre-stress is adjustable.

3. The centrifugal decanter of claim 2, wherein the adjustment of the pre-stress of each of said springs is effected with the aid of a compression member of which the position is adjustable.

4. The centrifugal decanter of claim 1. wherein said first and second elements are two substantially horizontal plates, namely a first plate fast with the swivel joint and a second fixed plate, fast with the seat thereof.

5. The centrifugal decanter of claim 4, wherein the first plate lies above the second plate.

6. The centrifugal decanter of claim 5, wherein said springs are interposed between the two plates.

7. The centrifugal decanter of claim 6, wherein each of said springs abuts directly on the second plate and, on the first plate, via a bush screwed in this plate, making it possible, by rotation, to adjust the pre-stress of the spring.

8. The centrifugal decanter of claim 5, wherein said springs are disposed above the first plate, the lower end of each spring abutting on the second plate via a respective small column on which the spring is mounted and which passes through the first plate, whilst this latter abuts on the upper end of said spring via a connecting member, which is constituted by a sleeve coaxial to the column and enclosing the spring, closed at its upper end by a threaded stopper of position adjustable by screwing in the sleeve, and at its lower end by a bottom presenting a central threaded hole in which is screwed a bush passing through the first plate with the column and possessing a flange on which this plate rests.

9. The centrifugal decanter of claim 4, comprising a casing which encloses the swivel joint suspension, the plates and the springs, wherein openings are made opposite the members for adjusting the pre-stress of the springs.

10. The centrifugal decanter of claim 1, wherein said springs are helicoidal springs or are constituted by elastic rings or stacked Belleville washers.

11. The centrifugal decanter of claim 1, wherein the angular return of the rotor into neutral position is ensured, apart from by said springs for compensating the weight of the rotor, by complementary return springs.

12. The centrifugal decanter of claim 1, wherein said springs for compensating the weight of the rotor are dimensioned and arranged so as to ensure, alone, the angular return of the rotor into neutral position.

* * * * *